United States Patent [19]

Roberts

[11] Patent Number: 5,021,610

[45] Date of Patent: Jun. 4, 1991

[54] STRAIN RELIEF CONNECTION

[75] Inventor: Kenneth P. Roberts, Asheville, N.C.

[73] Assignee: Square D Company, Palatine, Ill.

[21] Appl. No.: 461,139

[22] Filed: Jan. 4, 1990

[51] Int. Cl.[5] ..... H01R 13/58

[52] U.S. Cl. ..... 174/65 R; 174/135; 439/469

[58] Field of Search ..... 174/65 R, 65 G, 65 SS, 174/135; 439/449, 460, 469, 470, 472, 473

[56] References Cited

U.S. PATENT DOCUMENTS

| | | | |
|---|---|---|---|
| 3,161,450 | 12/1964 | Goodenough | 174/66 X |
| 3,667,783 | 6/1972 | Sotolongo | 174/65 SS X |
| 4,193,604 | 3/1980 | Sarvanne | 174/65 SS X |

FOREIGN PATENT DOCUMENTS

| | | | |
|---|---|---|---|
| 0106001 | 4/1984 | European Pat. Off. | 174/65 R |
| 2211119 | 4/1972 | Fed. Rep. of Germany | 174/65 SS |
| 3724053 | 9/1988 | Fed. Rep. of Germany | 174/65 SS |

*Primary Examiner*—Laramie E. Askin
*Attorney, Agent, or Firm*—Michael J. Femal

[57] ABSTRACT

A connector 10 for protecting, clamping, and sealing a cable passing through an aperture of a housing 14 for electrical or electronic equipment. A portion 15 of the housing 14 includes an aperture 34 for accepting a bushing 18. The bushing 18 includes a passage for a cable 26 and a pair of jaws 82 for clamping the cable 26 to prevent movement. The portion 15 of the housing 14 also includes an aperture 54 for inserting a locking clip 22 which locks the bushing 18 in the portion 15 of the housing 14. The locking clip 22 also provides the force required to activate the clamping jaws 82 on the bushing 18. A sealing ring 30 is compressed between the end 90 of the bushing 18 and a bevel surface 94 in the portion 15 of the housing 14 to close off the aperture.

6 Claims, 3 Drawing Sheets

STRAIN RELIEF CONNECTION

FIELD OF THE INVENTION

The present invention generally relates to a connector for connecting an electrical cable into a housing of an electrical or electronic device. Specifically, the present invention provides for a liquid tight seal at the cable entry point into the housing while clamping the cable to prevent strain damage or internal movement of the cable inside the housing.

BACKGROUND OF THE INVENTION

Previous methods of cable strain relief require multiple pieces for clamping a cable in a bushing and for attaching the bushing to a housing. If a liquid tight seal was required, a sealing material was added to a cavity in the bushing after the cables were installed, or a portion of the bushing was hermetically sealed to the cable.

SUMMARY OF THE INVENTION

The invention comprises a connector for protecting, clamping, and sealing a cable to a housing of an electrical or electronic device. The connector comprises a portion of the housing having an interior surface, an exterior surface, and a passage between the interior surface and the exterior surface. The connector further comprises a bushing for enclosing the cable at the point of entry into the housing, means for simultaneously clamping the cable in the bushing and locking the bushing into the housing, and means, locatable between the housing and the bushing for sealing between the passage, the bushing, and the cable to prevent liquids from entering the housing.

One of the principal features of the invention is the provision of a new strain relief connection which with a minimal number of parts accomplishes the successful connection of a cable to a housing while at the same time sealing the housing to prevent liquids from entering the housing.

Other features and advantages of the invention will become apparent to those skilled in the art upon review of the following detailed description, claims and drawings.

Figure 1:
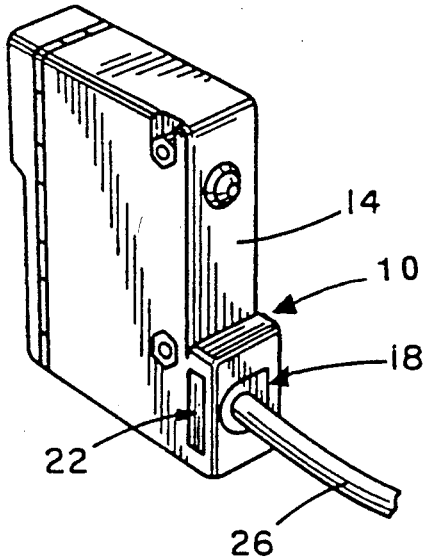
FIG. 1 is an isometric view of a housing for an electrical or electronic device showing the cable in a bushing and a locking clip in place.
Figure 2:
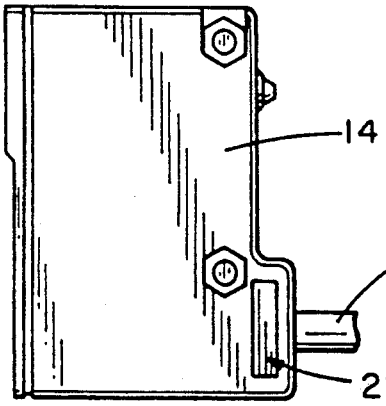
FIG. 2 is a side view of the housing showing the cable and the locking clip.
Figure 3:
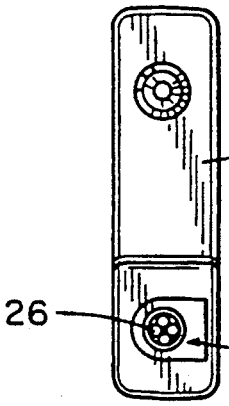
FIG. 3 is an end view of the housing showing the cable in the bushing.

Before one embodiment of the invention is explained in detail, it is to be understood that the invention is not limited in its application to the details of construction and the arrangement of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DETAILED DESCRIPTION OF THE PREFERRED EMBODIMENT OF THE INVENTION

A fully assembled connector 10 for protecting, clamping and sealing a cable 26 to a housing 14 for an electrical or electronic device is illustrated in FIG. 1. The connector 10 includes a portion 15 of the housing 14 and a generally tubular shaped bushing 18 having a flange 19 for protecting the cable 26 at the point of entry into portion 15 of the housing 14. The connector 10 also includes a generally U-shaped locking clip 22 having a flange 23 which locks the bushing 18 into the portion 15 of the housing 14 and which provides the required force for clamping the cable 26 in the bushing 18.

Figure 7:
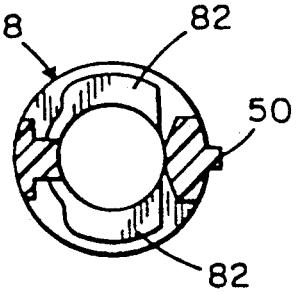
FIG. 7 is a cross-sectional view along the line 7—7 of FIG. 5 of the bushing showing the clamping jaws.

The cable 26, which encloses the power or control wires, enters the portion 15 of the housing 14 through the bushing 18. The cable 26 also passes through a generally donut-shaped sealing ring 30. The portion 15 of the housing 14 includes a configuration defining a passage 34, an exterior surface 38 and an interior surface 42. The passage 34 connects the exterior surface 38 with the interior surface 42 and receives the bushing 18. The portion 15 of the housing 14 also includes a keyway 46 running longitudinally along the passage 34 and a keyed indentation 17 of a predetermined depth and shape. The keyway 46 mates with a longitudinal rib 50 (See FIG. 7) on the bushing 18 to maintain proper alignment of the bushing 18 in the passage 34. The flange 19 inserts into the keyed indentation 17 so that the outer surface of the flange 19 is flush with the exterior surface 38 when fully inserted, which makes the bushing 18 generally resistant to removal, rotation or tampering therewith.

Figure 4:
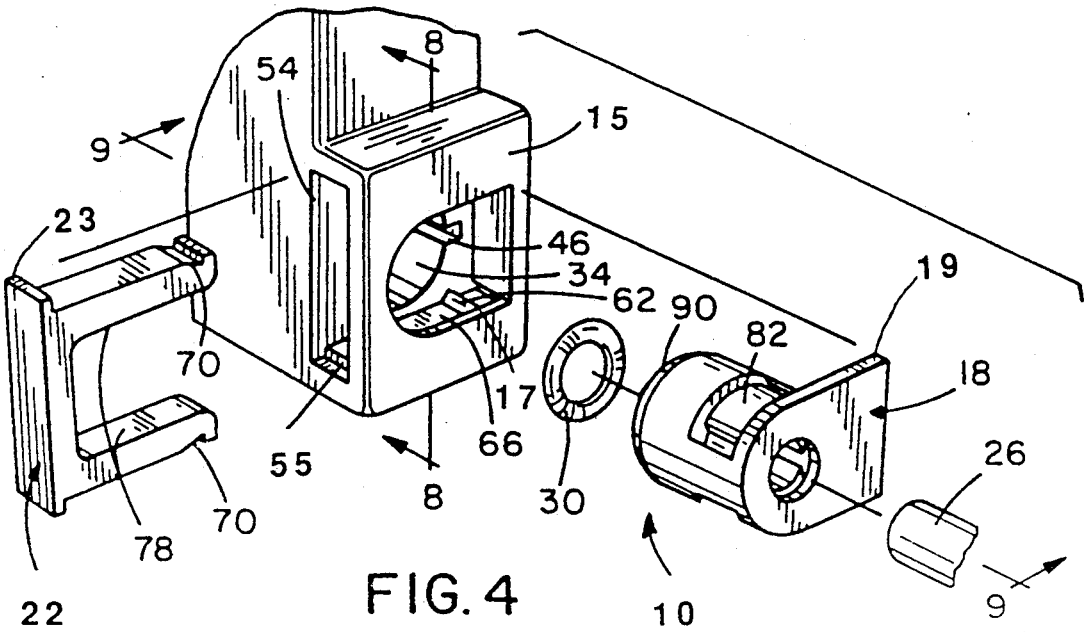
FIG. 4 is an exploded view showing a portion of the housing, the bushing, the cable, a sealing ring, and the locking clip.
Figure 5:
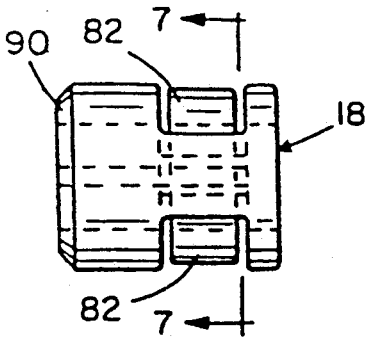
FIG. 5 is a side view of the bushing.
Figure 6:
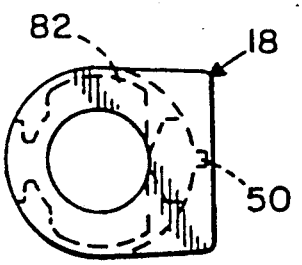
FIG. 6 is an end view of the bushing.
Figure 8:
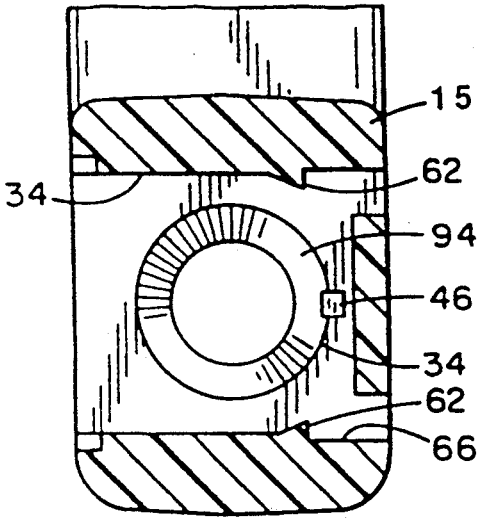
FIG. 8 is a cross-sectional view along the line 8—8 of FIG. 4 of the housing showing an aperture for the locking clip with wedge-shaped protrusions for locking the clip in place.
Figure 9:
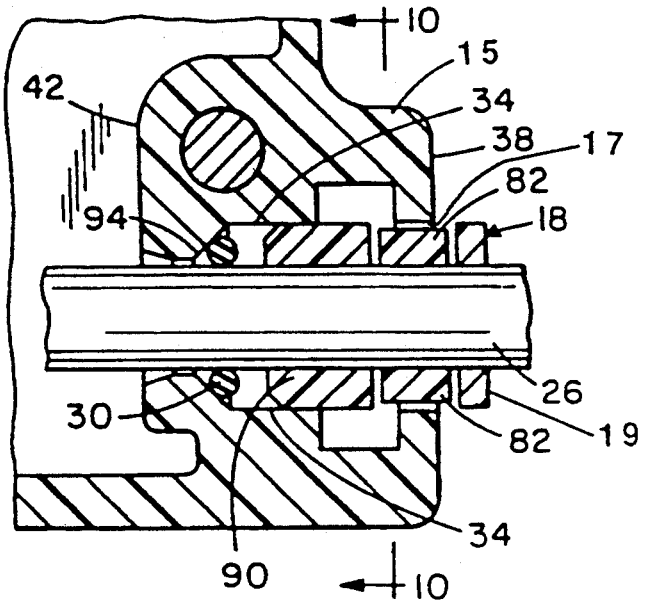
FIG. 9 is a cross-sectional view along the line 9—9 of FIG. 4 of the housing with the cable and the sealing ring in place and the bushing partially inserted.

The locking clip 22 is inserted into the portion 15 of the housing 14 defining a rectangular aperture 54 (See FIG. 4) perpendicular to and passing through the passage 34 and having an offset indentation 55. The portion 15 of the housing 14 also includes portions defining opposed wedge-shaped protrusions 62 (See FIG. 8) on two opposed surfaces 66 of the rectangular aperture 54. The protrusions 62 extend into the aperture 54. The locking clip 22 includes a pair of wedge-shaped notches 70 located on two outside surfaces 74 of the locking clip 22. The wedge-shaped protrusions 62 of the rectangular aperture 54 engage the wedge-shaped notches 70 on the locking clip 22 to lock the bushing 18 into the housing 14 in a generally tamper-resistant manner with its flange 23 flush with the exterior surface 38 of the portion 15 of the housing 14 as seen in FIG. 1.

Figure 10:
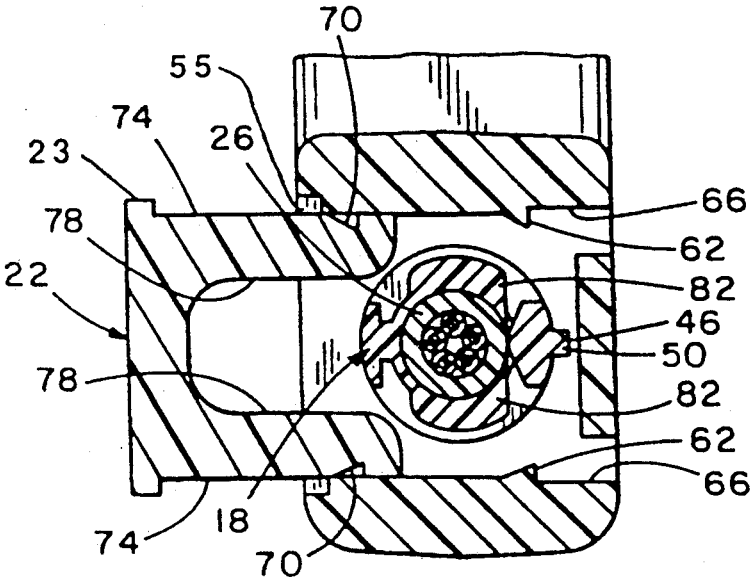
FIG. 10 is a cross-sectional view along the line 10—10 of FIG. 9 of the housing with the cable and bushing installed and the locking clip partially inserted.
Figure 11:
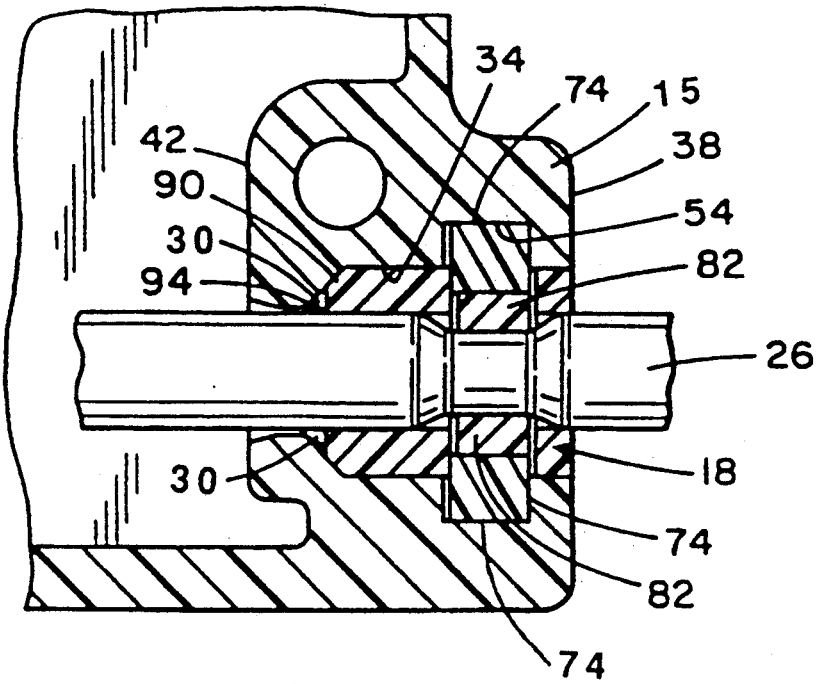
FIG. 11 is a cross-sectional view of the housing showing the sealing ring compressed when the bushing and locking clip is installed.
Figure 12:
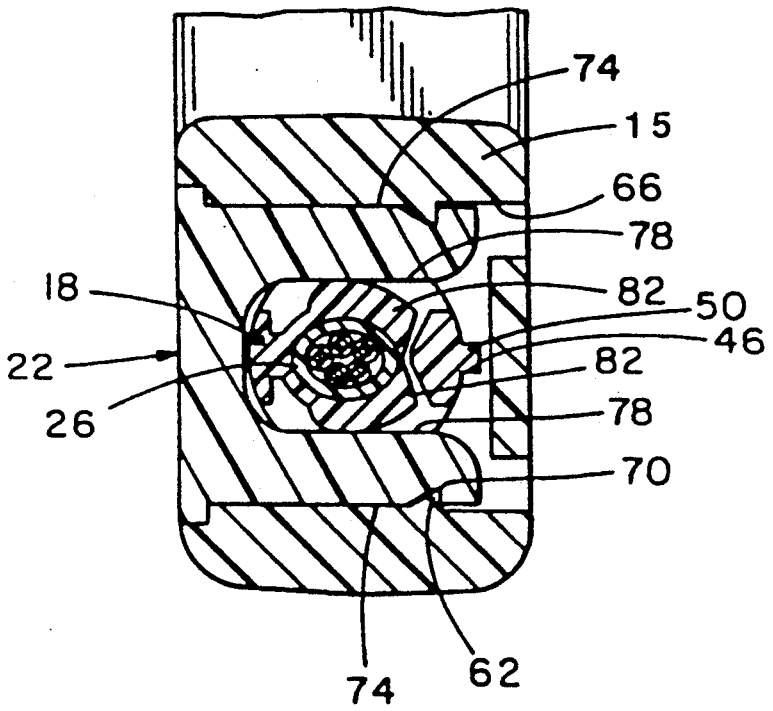
FIG. 12 is a cross-sectional view of the housing showing the locking clip forcing the hinged clamping jaws of the bushing around the cable.

The locking clip 22 also includes two opposing inside surfaces 78 which exert pressure on a pair of integrally hinged jaws 82 (See FIG. 7 and 10) of the bushing 18 which causes the jaws to clamp the cable 26 as shown in FIG. 12. The jaws 82 clamp tightly around the cable 26 to prevent any movement of the cable 26 in the bushing 18. When the bushing 18 is fully inserted into the passage 34 and locked in place by the locking clip 22, the sealing ring 30 is compressed between a generally conically-shaped bushing end 90 and a housing portion 94 defining a bevel at the interior end of the passage 34. The compressed sealing ring 30 forms a liquid tight barrier at the interior end of the passage 34 preventing the ingress of liquids into the housing 14.

Various features of the invention are set forth in the following claims.

I claim:

1. A strain relief connector for connecting an electrical cable into a housing of an electrical or electronic device, said connector comprising:

a. a portion of the housing including an interior surface, an exterior surface, and a passage between said interior and exterior surfaces, b. a bushing insertable into said passage for enclosing the cable at its point of entry into said housing, c. means connectable to the portion of the housing and extending generally perpendicular to the axis of the bushing for simultaneously clamping the cable in said bushing and for locking said bushing and cable into said portion of the housing in a generally tamper-resistant manner, and d. means locatable between the portion of the housing and said bushing for sealing between the passage, said bushing, and the cable to prevent liquids from entering the housing.

2. The connector of claim 1 wherein the portion of the housing includes a keyway running longitudinally along the passage and a bevel at the interior end of the passage and wherein said bushing is generally tubular in shape having a first end generally conical in shape matable with the passage bevel, a longitudinal rib receivable in the keyway for alignment of said bushing within the portion of the housing, and a pair of hinged jaws responsive to said clamping and locking means for clamping the cable to prevent movement of the cable within said bushing.

3. The connector of claim 2, wherein the portion of the housing includes a rectangular opening perpendicular to and passing through the passage, and a wedge-shaped protrusion on two opposing surfaces of the rectangular opening and extending a predetermined distance into the rectangular opening, and wherein the clamping and locking means includes a generally U-shaped retainer clip insertable into the rectangular opening, said clip having two opposing inside surfaces which apply pressure to said bushing hinged jaws to clamp the cable, and two outside wedge-shaped notches, each of which is engageable with the opposing protrusions in the rectangular opening to lock the clip in place on the portion of the housing in a tamper-resistant manner.

4. The connector of claim 3, wherein the sealing means includes a generally donut-shaped ring, said ring being compressed between the bevel and said bushing when the bushing is fully inserted into the passage and is locked in place by the retainer clip, and being constrictable around the cable to effect a seal to prevent liquids from entering around the cable into the housing.

5. The connector of claim 3, wherein the rectangular opening includes an offset indentation on at least one side of the opening of a predetermined depth and shape and wherein the clip includes a flange on the outside surface of the bottom leg of the U-shaped clip so that when the clip is inserted into the rectangular opening, the flange is flush with the surface of the portion of the housing adjacent said rectangular opening for providing a generally tamper-resistant clip which is difficult to remove or tamper therewith.

6. The connector of claim 2, wherein said portion of the housing includes a keyed indentation of a predetermined depth and shape on the exterior surface adjacent the passage and wherein said bushing includes a second end having a flange with a thickness and shape corresponding to the keyed indentation so that the bushing can be fully inserted into the portion of the housing with its second end flush with the exterior surface of the housing as well as further keyed in place by the flange for providing a generally tamper-resistant connection which makes it difficult to remove, rotate or tamper with the bushing.

* * * * *